United States Patent [19]

Paulson et al.

[11] 4,140,335

[45] * Feb. 20, 1979

[54] FORM FASTENINGS

[75] Inventors: William T. Paulson, Kettering, Ohio; David M. Davidson, deceased, late of Dayton, Ohio, by Clara A. Davidson, executrix

[73] Assignee: The Standard Register Company, Dayton, Ohio

[ * ] Notice: The portion of the term of this patent subsequent to Dec. 4, 1990, has been disclaimed.

[21] Appl. No.: 809,996

[22] Filed: Jun. 27, 1977

Related U.S. Application Data

[60] Continuation of Ser. No. 673,965, Apr. 5, 1976, abandoned, which is a division of Ser. No. 378,720, Jul. 12, 1973, abandoned, which is a continuation-in-part of Ser. No. 156,703, Jun. 25, 1971, abandoned, which is a continuation-in-part of Ser. No. 800,167, Feb. 18, 1969, abandoned.

[51] Int. Cl.[2] ..... B41L 1/36; B41M 5/16

[52] U.S. Cl. ..... 282/27.5; 156/231; 156/247; 427/146; 427/148; 427/152; 427/261; 428/215; 428/332; 428/511; 428/537; 428/913; 428/914

[58] Field of Search ..... 156/244, 247, 231; 281/21 R; 282/22 R, 27.5, DIG. 2; 427/152, 146, 171, 172, 177, 179, 148; 428/408, 914, 213, 535, 215, 216, 334, 99, 511, 537

[56] References Cited

U.S. PATENT DOCUMENTS

| | | | |
|---|---|---|---|
| 2,260,601 | 10/1941 | Brenn | 282/DIG. 2 |
| 2,503,680 | 4/1950 | Newman | 282/DIG. 2 |
| 2,557,875 | 6/1951 | Kerr | 282/22 R |
| 2,944,586 | 7/1960 | Yanulis | 156/500 X |
| 3,037,879 | 6/1962 | Newman et al. | 428/914 |
| 3,410,712 | 11/1968 | Winzer | 282/28 R |
| 3,413,184 | 11/1968 | Findlay et al. | 156/231 X |
| 3,565,712 | 2/1971 | McCarthy | 281/21 R |
| 3,776,755 | 12/1973 | Paulson et al. | 282/27.5 |

*Primary Examiner*—Thomas J. Herbert, Jr.
*Attorney, Agent, or Firm*—Jacox & Meckstroth

[57] ABSTRACT

A plurality of sheets are attached together by one or a plurality of thin films or layers of tough flexible material. A film may attach two sheets together firmly or in a releasable manner to permit relative movement between the sheets. In one form of the invention, each film or layer of flexible material is attached by self-bonding to the sheets between which the film or layer is disposed. In another form of the invention, each film is self-bonded to only one sheet and a plurality of films are attached together to attach a plurality of sheets together. The film may carry image transfer material on a complete surface thereof or on a portion thereof, in addition to serving as attachment means for adjacent sheets. In another form of this invention, the film serves only as a means for attachment of adjacent sheets, one to the other. In one form of the invention, the elastic characteristics of the film are employed in urging adjacent sheets to remain in predetermined fixed relationship, while permiting relative movement between adjacent sheets when forces occur which urge such relative movement, such as during folding, or during movement of the sheets over a drum or during angular movement of the sheets and the like.

5 Claims, 15 Drawing Figures

FORM FASTENINGS

RELATED APPLICATIONS

This application is a continuation of application Ser. No. 673,965, filed Apr. 5, 1976, now abandoned, which is a division of application Ser. No. 378,720, filed July 12, 1973, now abandoned, which is a continuation-in-part of copending application Ser. No. 156,703, filed June 25, 1971, now abandoned, which is a continuation-in-part of application Ser. No. 800,167, filed Feb. 18, 1969, now abandoned.

BACKGROUND OF THE INVENTION

Numerous types of forms fastening means and methods have been devised for fastening together a plurality of superposed sheets in a business form assembly or the like. Preferably, continuous superposed business forms are attached together in a manner which permits relative movement between adjacent sheets. However, a satisfactory attachment means may also be one which firmly or permanently attaches together adjacent sheets.

An object of this invention is to provide means by which adjacent sheets or strips can be attached together either permanently or releasably to provide for relative movement therebetween.

It is another object of this invention to provide means for attaching adjacent superposed sheets together in such a manner that relative movement between the adjacent sheets is permitted, while also providing means for urging the sheets to return to normal relative positions, after forces urging relative movement of the sheets away from normal positions are removed.

Another object of this invention is to provide film attachment means by which a plurality of superposed sheets are attached together by means which also carries image transfer material.

Another object of this invention is to provide such attachment means which has such thin dimension that the attachment means does not appreciably add to the thickness of a set of forms or the like which are attached together by the attachment means.

Another object of this invention is to provide such attachment means which are relatively low in cost.

Another object of this invention is to provide such attachment means by which adjacent sheets can be rigidly attached together or can be releasably attached together in a manner to permit relative movement therebetween.

Other objects and advantages reside in the construction of parts, the combination thereof, the method of manufacture, and the operation thereof, as will become more apparent from the following description.

SUMMARY OF THE INVENTION

A film or layer of material is disposed between adjacent superposed sheets and is attached thereto. The film or layer may carry image transfer material such as carbon or the like, or the film may be free from transfer material. The film may firmly secure the two adjacent sheets together or the film may permit relative movement between the sheets, the film may urge the sheets which are attached thereto to return to normal positions, after forces urging movement thereof are removed.

DETAILED DESCRIPTION OF THE DRAWINGS

Figure 1:
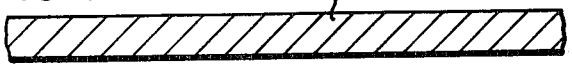
FIG. 1 is an enlarged fragmentary sectional view of a sheet or substrate which may have attachment means of this invention attached thereto.

A suitable support sheet or substrate 10, such as a sheet of paper which is intended to carry information, is shown in FIG. 1. The support sheet 10 may be, for example, a sheet of bond paper or the like or any other suitable sheet of material. The sheet 10 may be a plain sheet or may be printed thereupon on either or both surfaces thereof, prior to becoming a part of a unit of this invention. The sheet 10 has characteristics which permit transmission of an image therethrough which is applied to a surface thereof during a printing process or the like.

Figure 2:
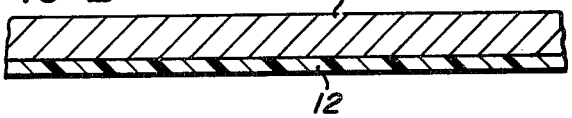
FIG. 2 is a fragmentary sectional view showing the substrate or sheet of FIG. 1 to which a carrier film or layer or attachment member has been applied in accordance with this invention.

A carrier film or layer 12 is applied to a surface of the support sheet 10 so that the sheet 10 with the carrier film 12 may appear in the manner illustrated in FIG. 2.

The carrier film 12 is preferably tough, flexible, and somewhat resilient, and may be, for example, a material of the plastics class, such as polyethylene or polypropylene or an ethylene copolymer or a wax blend thereof, or the film material may consist of an asphalt based composition, or other suitable material.

The film 12 may cover a portion or portions of the sheet 10 or the entire surface of the sheet 10.

The film 12 may be attached to the sheet 10 in any suitable manner. The preferred method of attachment of the film 12 to the sheet 10 is that of self-bonding. The term self-bonding includes attachment of the film 12 to the sheet 10 by application of pressure therebetween and/or by application of heat thereto so that the film self-bonds to the sheet. The term "bonding" also includes attachment of the film 12 to the sheet 10 by use of adhesive material or the like. In some embodiments and in some areas thereof a relatively weak degree of self-bonding of the film 12 to the sheet 10 is desirable. In other embodiments and in some areas thereof, a permanent type of self-bonding is desired. The desired degree of self-bonding may be controlled or obtained by various methods such as by controlling the magnitude of heat and/or pressure applied to the film 12 and/or the sheet 10. Other factors affecting the degree of self-bonding include the method of attachment, the composition of the carrier film 12, the composition of bonding material, the temperature of the carrier film 12 and of the sheet 10, surface conditions of the sheet 10 and the pressure of application of the carrier film 12 to the sheet 10. The sheet 10 may be treated with a light water spray or steam spray for dampening thereof immediately prior to application of the carrier film 12 to the sheet 10 to reduce or control the degree of self-bonding of the carrier film 12 to the sheet 10.

The carrier film 12 is preferably extruded upon the sheet 10 or coated thereupon by a blade coating process. Alternatively, the film 12 may constitute a separate sheet or strip or lamination which is brought into contact with the sheet 10 and attached thereto.

Attachment of the carrier film 12 to the sheet 10 may be over the entire mutual area or at any portion of the mutual area. For example, attachment may be at or along randomly or regularly spaced lines or spots or areas, or attachment may be only along one or more edges or margins of the carrier film 12.

The carrier film 12 is of a material which is sufficiently deformable for transmission of pressure therethrough which is applied to the sheet 10. Preferably, the thickness of the carrier film 12 upon the sheet 10 is very limited. The carrier film 12 is preferably in the order of 0.00025 to 0.0005 inches in thickness. However, films of other thicknesses are satisfactory. For example, films of thicknesses greater than 0.001 inch have been found to be suitable. Also, films having a thickness as low as 0.00015 have been found satisfactory. A film of a dimension as set forth herein reduces the total thickness of a set of transfer sheets and permits high quality multiple copy impressions.

The sheet 10 thus serves as support means for the relatively thin carrier film 12, enabling the film 12 to be utilized in strip or web form without undue stretching or breaking of the film 12.

An image transfer layer or transfer-imaging layer 14, for example, a coating of a carbon ink of the wax based, or solvent based, or plastisol type or the like is applied to the surface of the carrier film 12. Preferably, the image transfer layer 14 is applied to the carrier film 12 after the carrier film 12 is applied to the sheet 10. However, in some cases, the image transfer layer 14 may be applied to the carrier film 12 prior to attachment of the film 12 to the sheet 10. The image transfer layer 14 may be applied to the carrier film 12 by a roll coating process or by a wire coating process or by a blade coating method or the like. The image transfer layer 14 may cover an entire surface of the carrier film 12 or only selected portions or areas thereof.

For example, the image transfer layer 14 may be located over the entire surface of the carrier film 12 or may be in stripes, or spots, or limited areas on the surface of the carrier film 12, or the image transfer layer 14 may cover all of the carrier film 12 except a marginal edge portion thereof.

Figure 3:
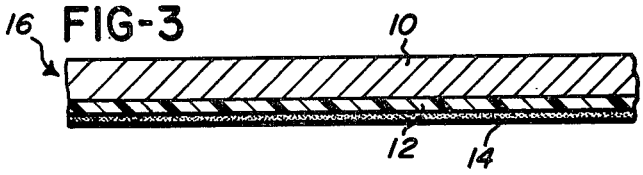
FIG. 3 is a fragmentary sectional view showing a transfer unit which includes the substrate or sheet of FIGS. 1 and 2, with the film or layer applied thereto and with transfer material applied to the carrier film or layer.

The carrier film 12 may be applied over an entire side surface of the sheet 10 or may be applied to a portion or portions of the sheet 10, as stated above, in order to position image transfer material in a limited desired location or locations on a sheet 10. Thus, a unit 16 is produced which includes the sheet 10, the carrier film 12 and the image transfer material or layer 14 and may appear substantially as illustrated in FIG. 3.

Figure 4:
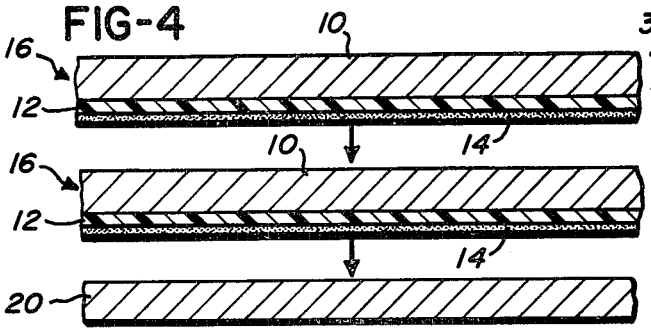
FIG. 4 is a sectional diagrammatic type of view illustrating the collating of a plurality of transfer units of FIG. 3. This view also shows a receptor sheet below the superposed transfer units.

FIG. 4 illustrates the process of collating a plurality of units 16 and a receptor sheet 20. The units 16 and the sheet 20 thus form a set or a unit set.

Figure 5:
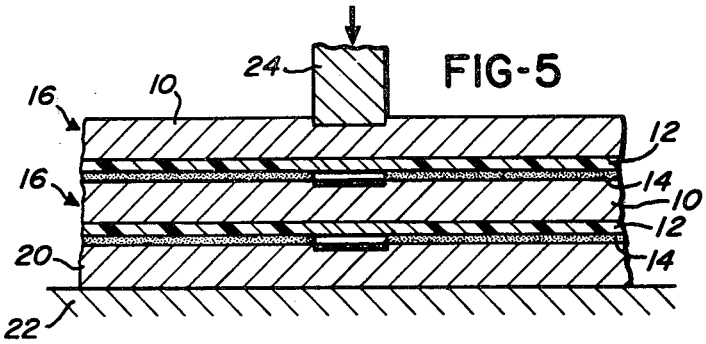
FIG. 5 is a sectional view showing the elements of FIG. 4 arranged in superposed relationship as a set and illustrating impressioning thereupon.

FIG. 5 illustrates the manner in which information may be applied to a unit or units 16 of the set. The receptor sheet 20 rests upon any suitable support structure 22. An impact or pressure member 24, such as a typewriter element or print element or the like, has an impression surface which engages the surface of the sheet 10 of the upper unit 16 and may print thereupon or may only apply image pressure thereupon. Usually, however, printing action occurs on the upper surface of the upper sheet 10 by image pressure of the member 24. Simultaneously, the image pressure is applied to the sheet 10, film 12, and transfer layer 14 in each of the lower positioned units 16 and the image pressure is applied to the receptor sheet 20. It is to be understood that other types of printing or other printing processes may also be employed in regard to the structure of this invention. Thus, a portion of the transfer material moves from each image transfer layer 14 to the sheet 10 or 20 which is in engagement therewith, as illustrated in FIG. 5. Such portion of the image transfer layer 14 transferred may be a solid portion of the image transfer layer 14 or image transfer may involve release of a portion of a liquid ink or the like contained in the image transfer layer 14.

Each unit 16 may be a continuous strip or web. Alternatively, each unit 16 may be an individual unit of suitable width and length dimensions.

Following impressioning or the application of information to superposed units 16 and to the sheet 20 in a manner such as that illustrated in FIG. 5, the units 16 and the sheet 20 are separated or decollated. Thus, individual units 16 and the sheet 20, as a separate sheet, are again provided.

Figure 6:
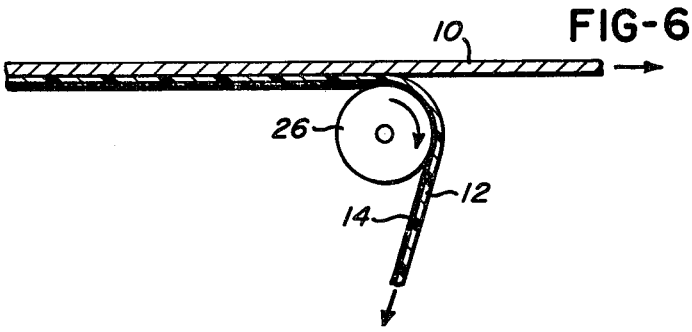
FIG. 6 is a sectional diagrammatic type of view, drawn on a much smaller scale than the other figures, illustrating an apparatus and method by which the film and the transfer material carried thereby are removed from the sheet or substrate.

Then each unit 16 is operated upon to separate the image transfer layer 14 from the sheet 10, by removal of the carrier film 12 from the sheet 10. Any suitable means and/or method may be used for separation of the carrier film 12 from the sheet 10. When each unit 16 is continuous, the unit 16 may be operated upon in a manner such as that illustrated in FIG. 6 for separation of the carrier film 12 from the sheet 10. A leading edge portion of the film or layer 12 is first separated from the sheet 10. Then the sheet 10 is moved in one direction, while the carrier film 12, with the image transfer layer 14 thereupon, is moved in another direction. Such action may be referred to as peeling action. A drum 26 may be used for such separation operation, as shown in FIG. 6. The carrier film 12 is thus removed from the sheet 10 as the sheet 10 moves forwardly from the drum 26, while the carrier film 12, with the image transfer layer 14 carried thereby, is moved downwardly from the drum 26 for separation of the carrier film 12 and the image transfer layer 14 from the sheet 10.

In accordance with this invention, a plurality of units 16 may be assembled as a unit set, as the units 16 are collated in the manner illustrated in FIG. 4. Then after impressioning thereupon in the manner illustrated in FIG. 5, the films 12 may be removed from the sheets 10 in any suitable manner.

Separation of the carrier film 12 from the sheet 10 may occur by peeling, as illustrated in FIG. 6. Separation action may be performed manually or by machine and may be referred to as stripping action. The word "strip", "stripping", or "strippable" as used in this application includes not only separation action by which there is angular peeling movement between the sheet 10 and the sheet 12, as illustrated in FIG. 6, but also includes separation by straight line movement which may be referred to as shearing action, and also includes any other type of action by which separation of the film 12 from the sheet occurs. Due to the fact that the attachment or bond of the carrier film 12 to the sheet 10 is relatively weak, as discussed above, the stripping or separating action can be readily performed.

Thus, in summary, each sheet 10 serves as support means for a film 12 which carries image transfer material 14. The sheet 10 also serves as means through which an image is transmitted to the film 12 and to the image transfer material 14 for transfer of a portion of the image transfer material 14 to a subjacent sheet or surface. Then after use of the sheet 10 as a carrier means and as means through which image pressure is transmitted, the transfer material 14 is removed from the sheet 10 by removal of the film 12 from the sheet 10. Thus, an information business form is produced which is free from transfer material. Printing may be applied to the sheet 10 before, during, or after use of the sheet 10 as a means through which image pressure is transmitted.

The structure of this invention is capable of producing excellent image transfer by pressure. The thickness of a unit 16, including a sheet 10, a carrier film 12, and an image transfer layer 14 is considerably less than the thickness of a sheet 10 and a separate tissue layer of carbon paper or transfer sheet having carbon or the like carried thereby. Furthermore, physical characteristics of a thin carrier film 12 having a layer of transfer material, such as set forth above, permit better image transfer therethrough by pressure than is possible by the use of a sheet of conventional carbon paper. Thus, a multiplicity of excellent copies may be made simultaneously in the use of structure of this invention.

The cost of a set of units made according to this invention is considerably less than that of a conventional set of forms in which transfer sheets are interposed between record sheets.

Figure 7:
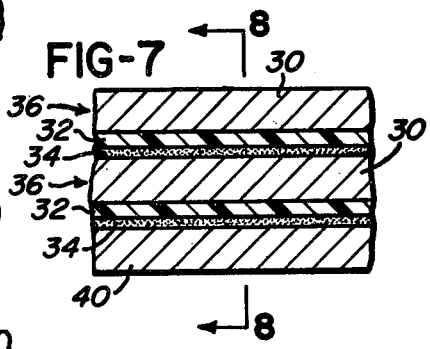
FIG. 7 is a sectional view, drawn on substantially the same scale as FIGS. 7–5, illustrating attachment of superposed sheets in accordance with this invention.
Figure 8:
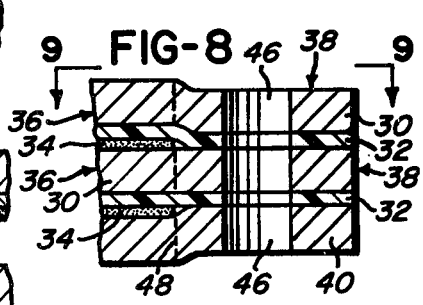
FIG. 8 is a sectional view taken substantially on line 8—8 of FIG. 7.
Figure 9:
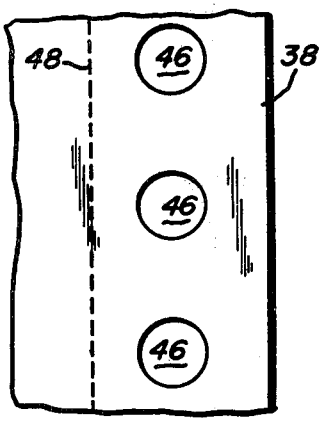
FIG. 9 is a plan view taken substantially on line 9—9 of FIG. 8.

FIGS. 7, 8 and 9 show a plurality of superposed business units 36, each of which is similar to a unit 16 of FIGS. 3–6. Each of the business units 36 includes a sheet 30, which is similar to a sheet 10 shown in FIGS. 1–6. Each sheet 30 has a film 32 self-bonded to the lower surface thereof so that the film is carried by the sheet 30. The film 32 is similar to the film 12 shown in FIGS. 2–6. Each business unit 36 also includes an image transfer coating or layer 34 which is carried by the film 32 on the lower surface thereof and which is similar to the image transfer layer 14 of FIGS. 3–6. Preferably, the image transfer coating 34 covers only a portion of the sheet 30 and extends only to a marginal edge portion 38 of the business unit 36, as shown in FIG. 8. The film 32 extends into the marginal edge portion 38 of the top business unit 36, and in addition to having the upper surface thereof self-bonded to the upper sheet 30, has the lower surface thereof self-bonded to the marginal edge portion 38 of the upper surface of the sheet 30 of the unit 36 which is immediately below the upper unit 36. The degree of self-bonding of each film 32 to the marginal edge portions 38 of the adjacent sheets 30, may be greater than the degree of self-bonding of the film 32 to the main portion of the overlaying sheet 32 so that the bond of the edge portion is substantially permanent. This higher degree of self-bonding of the film 32 to the marginal edge portion 38, may be determined by the degree of applied heat and/or pressure and is frequently desirable in unit-form sets which are usually not connected to form a continuous series of forms and are commonly stacked rather than zig-zag folded. Thus, the film 32 of each unit 36, in addition to being self-bonded to the lower surface of the sheet 30 which is immediately thereabove, is also self-bonded to the marginal edge portion 38 of the upper surface of the sheet 30 of the unit 36 which is immediately therebelow. Below the lower most unit 36 is a sheet 40, similar to the sheet 20 of FIGS. 4 and 5. The upper surface of the marginal edge portion 38 of the sheet 40 is self-bonded to the lower surface of the film 32 of the unit 36 which is immediately thereabove.

Thus, each film 32 attaches together two adjacent sheets in a forms fastening arrangement. It is to be understood that each film 32 may be bonded to adjacent sheets at any portion of the sheets, such a portion may be other than a marginal portion.

Thus, a set of business forms or units is produced in which at least a portion of each sheet thereof is attached by means of a film or layer 32 to a portion of each sheet which is immediately adjacent thereto. Preferably, the film 32 carries image transfer material 34 over at least a portion of the film.

FIGS. 7 and 8 show holes 46 in the marginal portion 38, which holes 46 may be used in the movement of the set of sheets, by pin feed means or the like. The marginal portions 38 may be separated from the other portions of the sheets by score lines or severance lines 48, shown in FIGS. 8 and 9. The lines 48 are especially desirable in unit form sets where the self-bonding of the film to the marginal edge portions is substantially permanent and it is desired to remove at least the main portion of the film 32 and the image transfer material 34 from the adjacent sheets 30.

Figure 10:
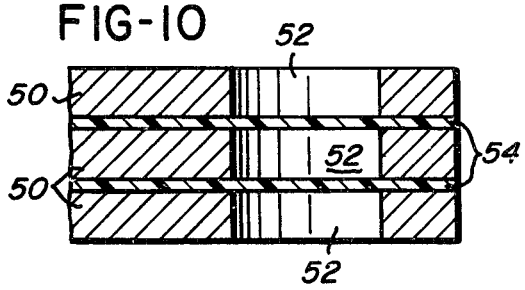
FIG. 10 is a sectional view, drawn on a larger scale than the other figures, showing a step in another method of attachment together of superposed sheets in accordance with this invention.
Figure 11:
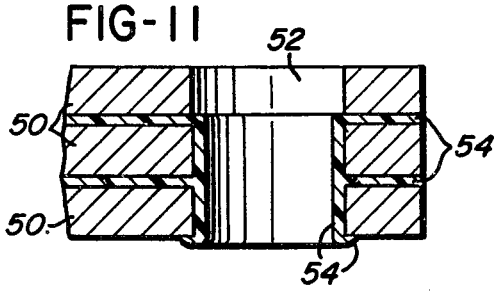
FIG. 11 is a sectional view illustrating another step in the attachment method shown in FIG. 10.

FIG. 10 shows a plurality of sheets 50, each of which has an aperture 52. A film 54 is disposed between adjacent sheets 50 and is self-bonded to the sheet immediately thereabove. The film 54 extends across the apertures 52, as shown in FIG. 10. The apertures 52 may constitute pin feed holes. A heated punch member or the like, not shown, may be forced through the apertures 52, from the top toward the bottom, and causes severance of the portions of the films 54 within the apertures 52. The heated punch also forces these portions of the films 54 to attach to the edges of the sheets 50 within the apertures 52. A suitable platen or the like, not shown, upon which the lowermost sheet 50 rests, may serve to force a portion of the film 54 against the lower surface of the lowermost sheet 50 at the periphery of the aperture 52. Thus, as illustrated in FIG. 11, each film 54 is self-bonded to the sheet 50 which is immediately thereabove and each film 54 is also attached to a plurality of sheets 50 within the apertures 52, and a portion of at least one of the films 54 is attached to a portion of the lower surface of the lowermost sheet 50. Thus, the films 54 not only serve as means for attaching the sheets 50 together, but portions of the films 54 also serve as liner means within the apertures 52 to protect the edges of the apertures 52 as the apertures 52 receive feed pins or the like for movement of a web which is formed by the sheets 50 and the films 54.

Figure 12:
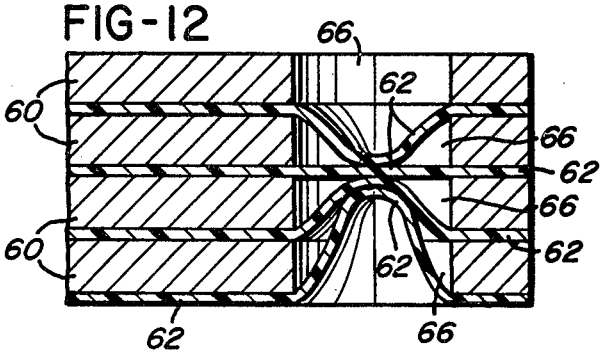
FIG. 12 is a sectional view illustrating another method of attaching together superposed sheets in accordance with this invention.

FIG. 12 shows a plurality of sheets 60, each of which has an aperture 66, which may consist of a hole through the sheet or a notch at the edge of a sheet. Each of the sheets 60 has a film 62 self-bonded to the lower surface thereof. The films 62 are attached together within the apertures 66, as shown in FIG. 12, by forcing a portion of all of the films 62 together within the apertures 66, by use of an instrument which applies heat and/or pressure to the films 62. Thus, all of the sheets 60 are attached together. Due to the fact that the films 62 are stretchable, relative movement between adjacent sheets 60 is permitted. All of the sheets 60 are attached together by the films 62. The films 62 may also have elastic qualities which urge the sheets 60 to given normal superposed positions after forces are removed which urge relative movement between the sheets.

Figure 13:
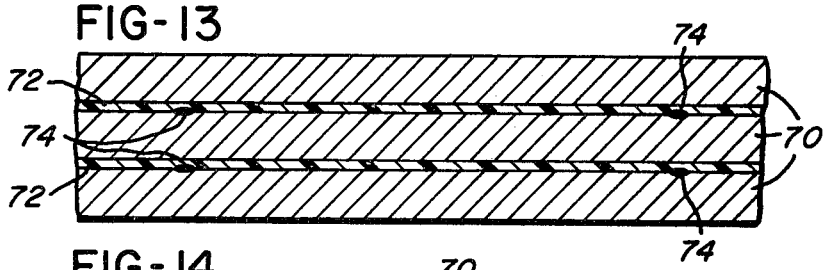
FIG. 13 is a sectional view showing another method of attachment of superposed sheets together in accordance with this invention.

FIG. 13 shows a plurality of sheets 70. Between each pair of adjacent sheets 70 is a film 72 which is preferably similar to the films 12 of FIGS. 2–6. Each film 72 is releasably self-bonded to the sheet 70 which is immediately thereabove. In addition, the lower surface of each film 70 is firmly attached to its subjacent sheet 70 at limited areas or lines or spots 74. Such firm attachment at the limited areas or lines or spots 74 may be accomplished by any suitable means, as for example, by the use of adhesive means, or by heat and/or pressure, or the like.

Figure 14:
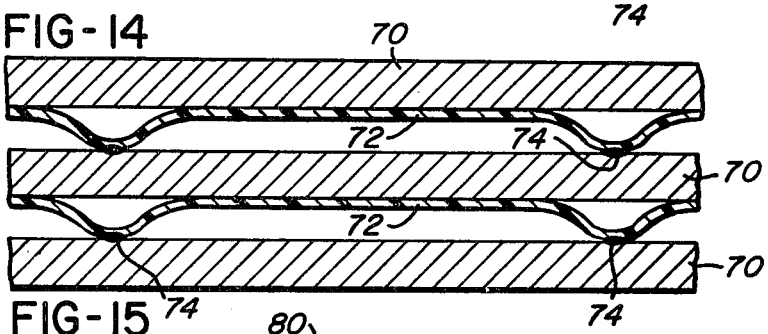
FIG. 14 is an expanded type of sectional view showing the superposed sheets of FIG. 13 in spaced relationship.

When the set of sheets 70 is moved angularly, or moved over drum members, or folded, or the like, forces may occur which tend to cause relative movement between adjacent sheets 70. When such forces occur, portions of the films 72 which are releasably self-bonded to the sheets 70 may become released from the sheets 70, as illustrated in FIG. 14 to permit relative movement between adjacent sheets 70.

A film of the type discussed herein may have resilient characteristics. Thus, after forces urging relative movement between adjacent sheets 70 are removed, the films 72 may cause the sheets 70 to return to the relative normal positions thereof. Thus, the films 72 attach the sheets 70 together and permit limited relative movement therebetween when such relative movement therebetween is desired, and the films 72 tend to return the sheets 70 to the desired normal relative positions after forces urging relative movement therebetween are removed.

Figure 15:
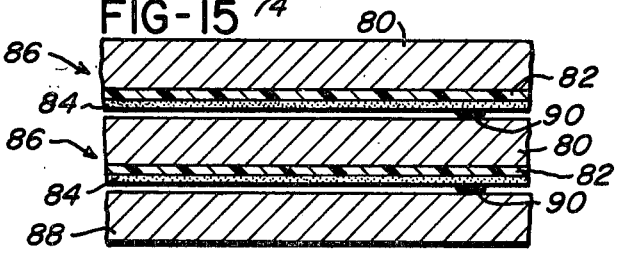
FIG. 15 is a sectional view showing another method of attachment of superposed sheets in accordance with this invention.

FIG. 15 shows a plurality of units 86, which may be similar to the units 16 of FIGS. 3–6. Each of the units 86 comprises a sheet 80, a film or layer 82 of carrier material releasably self-bonded to the sheet 80, and a layer of image transfer material 84 carried by the film 82. A sheet 88 is also shown below the lowermost unit 86. Each film 82 is releasably self-bonded to the sheet 80 which is in engagement therewith.

At limited areas or spots or lines 90, adjacent units 86 are attached together, as shown by attachment of a subjacent sheet 80 to an image transfer layer 84 of a unit 86 thereabove. If desired, the transfer layer 84 may be omitted from an area of the film 82 and attachment made directly to the film 82. Any suitable means may be employed for such attachment, as for example, pressure sensitive adhesive, or the like. With the sheets 80 so attached together, relative movement therebetween is readily permitted, as portions of the films 82 are released, in the manner illustrated in FIG. 14 with respect to the films 72.

Although the preferred embodiments of the structure have been described, it will be understood that within the purview of this invention various changes may be made in the form, details, proportion and arrangement of parts, the combination thereof and methods of production, which generally stated consist in structure and methods capable of carrying out the objects set forth, as disclosed and defined in the appended claims.

We claim:

1. A multiple copy business form assembly comprising a first paper record sheet positioned in superposed relation with a second paper record sheet, a thin flexible film sheet of plastics material disposed between said first and second record sheets and including a main portion and a marginal edge portion having a uniform thickness, said film sheet of plastics material having a thickness less than 0.0005 inch, said main portion of said film sheet of plastics material carrying a coating of image transfer material disposed adjacent said second record sheet, heat and pressure bonding means bonding corresponding marginal edge portons of said first and second paper record sheets and consisting of said marginal edge portion of said film sheet, said film sheet effectively fastening said record sheets together in addition to carrying said coating of image transfer material, and said main portion of said film sheet and said coating carried thereby being separable from said record sheets.

2. A business form assembly as defined in claim 1 including a third paper record sheet positioned adjacent said second record sheet and having a corresponding marginal edge portion, a second said flexible film sheet of plastics material disposed between said second and third record sheets, said second film sheet including a main portion and a marginal edge portion having a uniform thickness, heat and pressure bonding means bonding corresponding said marginal edge portions of said second and third paper record sheets and consisting of said marginal edge portion of said film sheet, and said main portion of said second film sheet carries a coating of image transfer material disposed adjacent said third record sheet.

3. A multiple copy business form assembly comprising a plurality of paper record sheets positioned in superposed relation, a thin flexible film sheet of plastics material disposed between each set of adjacent record sheets and including a main porton and a marginal edge portion having a uniform thickness less than 0.0005 inch, said main portion of each said film sheet of plastics material carrying a coating of image transfer material disposed adjacent the underlying said record sheet, said marginal edge portion of each said film sheet being free of said coating, heat and pressure bonding means bonding corresponding marginal edge portions of adjacent said paper record sheets and consisting of said marginal edge portion of said film sheet, each said film sheet effectively fastening the adjacent said record sheets together in addition to carrying said coating of image transfer material, and said main portion of each said film sheet and said coating carried thereby being separable from said adjacent record sheets.

4. A method for producing a business form article, comprising the steps of directing a carrier web along a predetermined path, extruding a continuous heated film of plastics material onto the carrier web, forming the film of plastics material on the carrier web to a film thickness less than 0.0005 inch, releasably self-bonding the thin film to the carrier web, coating a layer of image transfer material onto at least a portion of the film on the carrier web, stripping the combined film and coated layer of image transfer material from the carrier web, directing the combined film and coated layer of image transfer material between first and second paper record webs, and applying heat and pressure to overlying corresponding marginal edge portions of the film and record webs to attach said edge portions together.

5. A method for producing a business form article, comprising the steps of directing a carrier web along a predetermined path, overlying the carrier web with a film of plastics material having a film thickness less than 0.0005 inch, releasably self-bonding the thin film to the carrier web, coating a layer of image transfer material onto a main portion of the film on the carrier web with a marginal edge portion of the film being free of the image transfer material, stripping the combined film and coated layer of image transfer material from the carrier web, directing the combined film and coated layer of image transfer material between first and second paper record webs, and applying heat and pressure to overlying corresponding marginal edge portions of the film and record webs causing the marginal edge portion of the film to attach the edge portions of the record webs together.

* * * * *

UNITED STATES PATENT AND TRADEMARK OFFICE

CERTIFICATE OF CORRECTION

PATENT NO. : 4,140,335

DATED : February 20, 1979

INVENTOR(S) : William T. Paulson and David M. Davidson

It is certified that error appears in the above-identified patent and that said Letters Patent are hereby corrected as shown below:

Column 2, line 28, change "FIGS. 7-5" to---FIGS. 1-5---.

Column 6, line 19, change "overlaying" to---overlying---.

Signed and Sealed this

*Fifth* Day of *June 1979*

[SEAL]

*Attest:*

RUTH C. MASON
*Attesting Officer*

DONALD W. BANNER
*Commissioner of Patents and Trademarks*